United States Patent [19]

Helgemeir

[11] 3,945,152

[45] Mar. 23, 1976

[54] RAIL HEAD RE-FORM GRINDING MACHINE

[76] Inventor: Heinrich Helgemeir, Allmannshausenerstr. 30, 8 Munich 70, Germany

[22] Filed: Mar. 5, 1975

[21] Appl. No.: 555,364

[30] Foreign Application Priority Data

Mar. 6, 1974 Germany ..... 2410564

[52] U.S. Cl. ..... 51/178

[51] Int. Cl.[2] ..... B24B 23/00

[58] Field of Search ..... 51/178, 165.74, 165.75, 51/165.76

[56] References Cited

FOREIGN PATENTS OR APPLICATIONS 800,766 9/1958 United Kingdom ..... 51/178

817,825 8/1959 United Kingdom ..... 51/178

*Primary Examiner*—James L. Jones, Jr.

*Attorney, Agent, or Firm*—Witherspoon and Lane

[57] ABSTRACT

A rail head re-form grinding machine is provided with an annular grinding wheel whose lower flat face is adapted to engage and grind the rail head. A circular feeler device fits within the annular grinding wheel and is also engaged by the rail head. The feeler device is vertically movable by a hydraulic piston arrangement the movement of the feeler device being sensed and indicated by a sensing and indicating assembly. The housing which mounts the grinding wheel and feeler device is pivotally carried so that an arcuate surface may be ground on the rail head.

8 Claims, 3 Drawing Figures

RAIL HEAD RE-FORM GRINDING MACHINE

Figure 1:
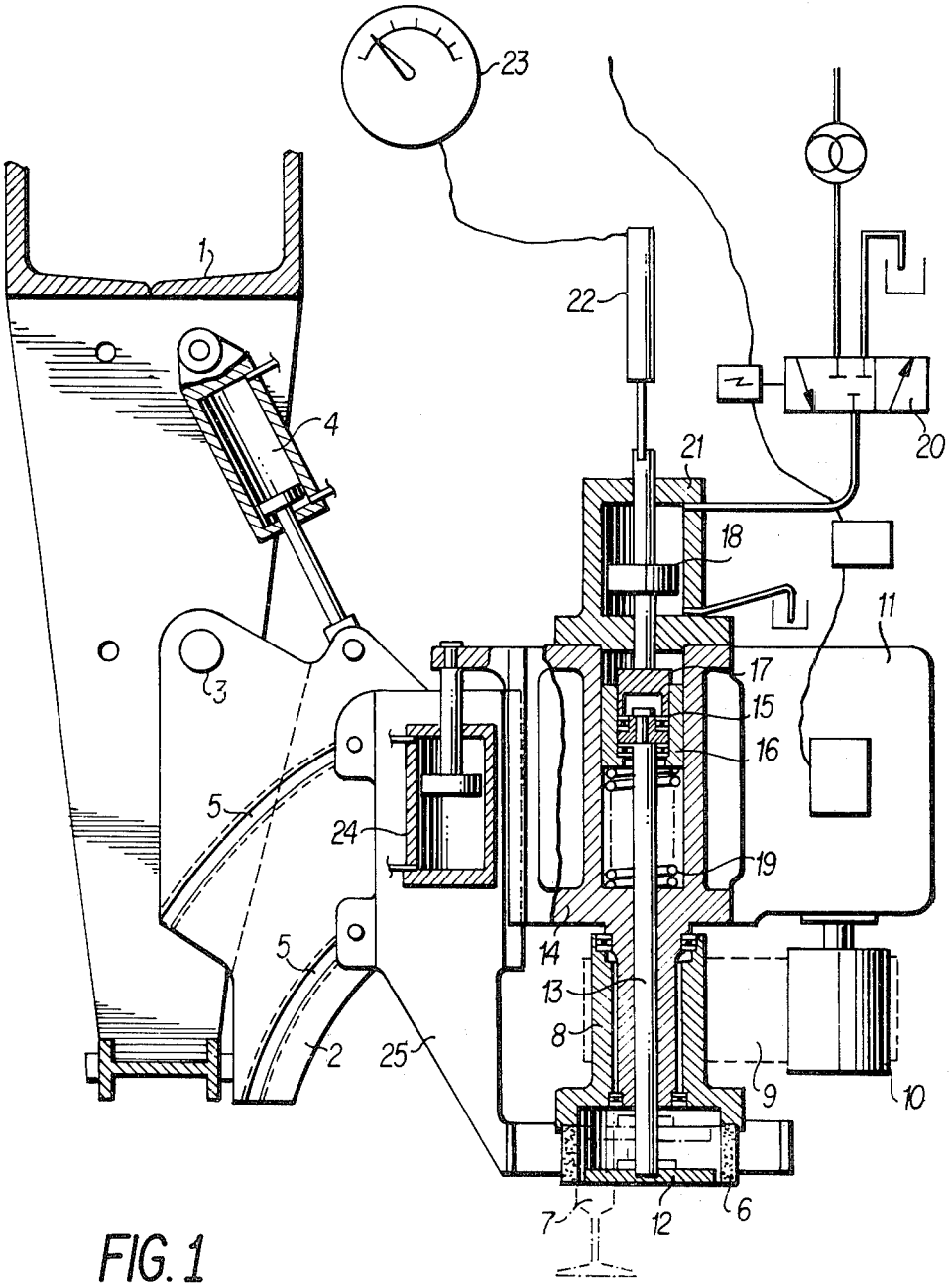

The invention concerns a rail head re-form grinding machine with a rotating grinding wheel operating at the front, through the center of which a feeler devise is provided within the grinding border of the grinding wheel and connected with an indication device.

A well known grinding machine as per is equipped with a feeler device, provided immediately within the grinding border of the grinding wheel and coupled with an indication device for measuring unevenness of rails. The grinding border is guided at the running surface of the rail by rollers arranged on both sides of the grinding wheel, this latter being fed according to the operator's experience and by means of the indication on the feeler device. The rail is treated by pushing back and forth of the machine. The guiding rollers of the grinding wheel follow the grooved eventually showing on the rail surface, thus copying their high and low points. Guiding elements arranged on both sides of the grinding wheel do not guarantee a straight guiding at the grinding spot. E.g. in case of grinding surfaces vaulted towards the inside, the grinding wheel would not attack, whereas in case of the inverse form at the same position of the grinding, this would grind too deeply. Guiding of the grinding wheel must be made immediately beside the grinding surface.

The invention is based on the requirement to guide a grinding wheel as immediately as possible at the rail head for the surface treatment, by an element in the most close vicinity. It must be able to operate without handicap out of the spraying range of the sparks; In addition, the guiding element must be able to receive feeler tasks at the rail surface on a large area, so that grooves that might show there (high and low points) may be compensated, in order to avoid re-copying of same. In order to keep the wear at the guiding element as low as possible, this has to roll together with the advance movement. A feeler device is provided to keep the front surface of the grinding wheel in the right distance to the rail for a good grinding job, at the same time compensating the wear of the grinding wheel. Furthermore, the feeler device shall facilitate the control of approaching the grinding wheel to the rail surface by means of remote indication of the distance. Also, the position of the feeler device shall indicate the degree of wear of the grinding wheel and the time when an exchange of the grinding wheel is necessary.

In addition, several grinding groups must be adjusted around the rail head, each one in another angle to the rail head. Due to a favourable design an easy way of maintenance of the feeler element and a good possibility of exchange of the grinding wheel shall be guaranteed.

The invention solves this problem by the fact that the feeler device is executed as an even plate almost filling out the clear width of the grinding wheel, being affixed to an axle axially adjustable and rotating with this axle, the feeler device being adjustable by means of pressure and by the facility to register the adjusting distance via an indicating device.

It is not possible to guide the grinding wheel at the rail surface more immediately than by means of this central arrangement. The plaste of the feeler device is preferably evenly ground and hardened; it will constantly follow the rotating movement under the load through the grinding group and due to the excentric arrangement at the grinding spot during the advance movement of the machine. The attacking surface of the plate within the grinding wheel is free from reduction due to rubbing off by grinding and by sparks. High and low points of grooves are bridged over.

A further elaboration of the invention will increase or reduce the weight of the grinding group on the feeler device by means of pressure, e.g. by a cylinder piston group, in order to increase or reduce the grinding pressure for an excellent job. The feeler device keeps the front surface of the grinding wheel in the right distance to the rail. Wear of the grinding wheel is compensated by a slight movement backwards of the plate of the feeler device. Wear of the grinding wheel is indicated to the operator by an indicating instrument for the current pick-up of the grinding motor. The grinding pressure is adjusted by hand or automatically according to this indication. Prior to setting of the grinding wheel to the rail head the plate of the feeler device is somewhat higher than the front surface of the grinding wheel. In order to approach the grinding wheel to the grinding surface, the plate is successively moved back by means of remote control. The indicating instrument for current pick up shows the touch according to the higher current consumption due to the grinding work. Since the rail head is slightly vaulted having a round running edge, the feeler device and the grinding wheel must be adjustable in the form of a semi-cercle around the rail head, by means of the guiding housing slewable in an angle. Therefor the eccentric attack of the grinding wheel and the touch of the plate on the rail head is to adjust in a way that the surface will bridge over the high and low points of grooves.

Furthermore, the elaboration of the invention provides to remove or put on the feeler device and the grinding wheel by means of cylinder piston groups in the form of a semi-circle from the rail, thus facilitating the free accessibility for easy exchange of wearing parts. This is an important factor for the output of the work.

An example of the execution of the object of invention is shown in the drawings.

Figure 2:
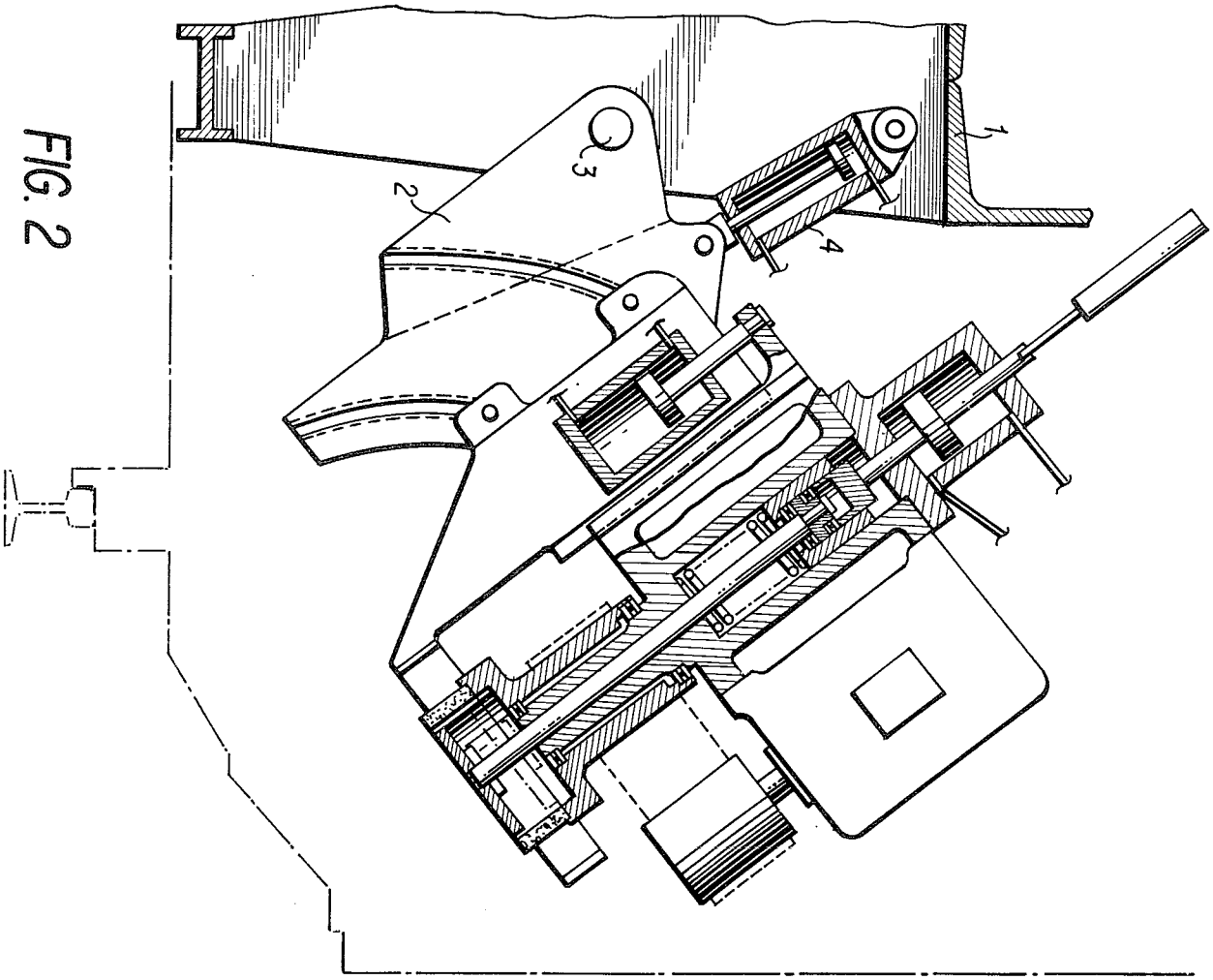
Figure 3:
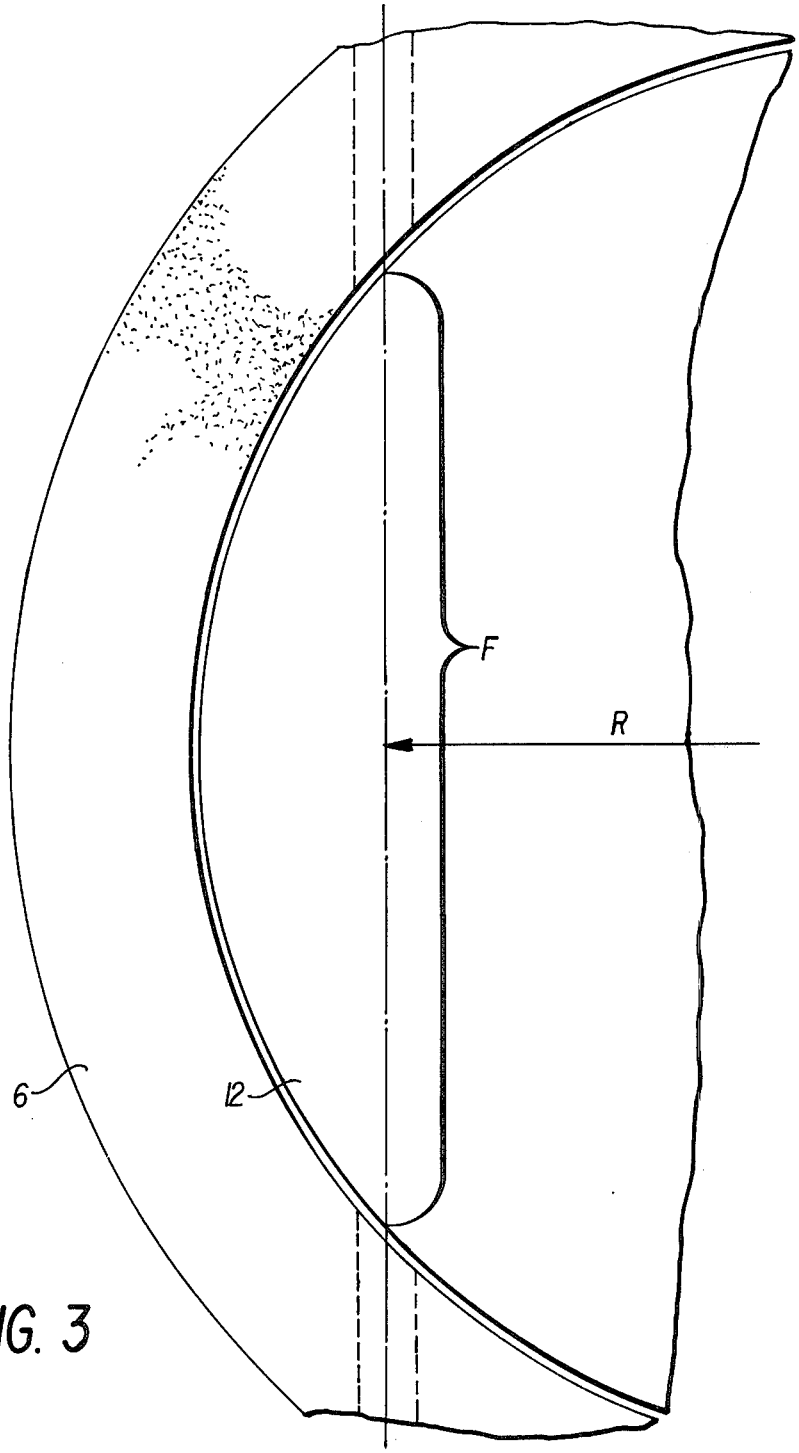

Showing:

FIG. 1 a view of the machine in operation;

FIG. 2 a view of the machine in the position for the maintenance and the exchange of the feeler device and the grinding wheel;

FIG. 3 a view on the feeler device and the grinding wheel touching the rail head grinding surface.

In FIG. 1 the vehicle frame carrying the rail head re-form grinding machine is designated with 1. Thereon a slewing housing 2 is located around the pivoting bolt 3, lifting and lowering the grinding group by the cylinder piston group 4, being moveable for free access for repair and exchange works. In the slewing housing 2, arc-shaped grooves 5 are provided for adjusting the grinding group opposite the rail head to the various angle degrees.

The grinding wheel 6 is a grinding ring which has to treat the rail head 7 with the front side. The grinding wheel is connected to a drive element 8, being driven via a drive belt 9 and belt pulley 10 from the motor 11.

The feeler device consisting of an evenly ground plate 12 and axle 13 is arranged within the grinding wheel 6. The axle 13 is incorporated in the housing 14 pivoting and axially moveable. At the interior end of the axle 13, antifriction bearings 15 are arranged, guiding the axle 13 without play in the longitudinal direction opposite the adjusting bush 16, pressure bush 17, and adjusting piston 18. In order to keep the axle 13 playfree, a pull-back spring 19 is also installed in the housing 14. The plate 12 is axially adjusted in such a manner that it determines the touch of the front edge of the grinding wheel 6 with the rail head 7. Prior to the attack of the grinding wheel, the plate 12 will be slightly higher than the front edge of the grinding wheel 6, in order to avoid an erronous spot grinding of the rail head 7. The operator controls a slide 20 in such a way that pressure is fed to the cylinder 21, in order to adjust the adjusting piston 18 so that the feeler device, particularly the plate 12, moves back into the plane of the front surface of the grinding wheel 6.

The beginning of the grinding process is indicated to the operator by the increase of the current pick-up of the motor 11 or by a changement in the current pick-up whereby a control impulse is transmitted to the slide 20. Simultaneously with the wear of the grinding wheel, the plate 12 is also moved back. The position of the feeler device consisting of the plate 12 and the axle 13 is determined by the degree of wear of the position of the adjusting piston 18 via an electric measuring device, e.g. a potentiometer, and is indicated to the operator by a indicating device. In case several grinding groups are arranged in a vehicle, the operator can reveal and determine the time when the grinding wheel has to be exchanged. The grinding wheel 6 needs a certain load to guarantee a good grinding job. This load can be achieved either by the weight of the grinding unit and on the other hand by a cylinder piston group 24. This load acts on the feeler device or the plate 12, when this plate shall avoid the attack of the grinding wheel 6 at the rail head 7, in its protruding position. The grinding unit, adjustable by the cylinder piston group 24, is arranged at the guiding housing 25. This guiding housing 25 is arranged opposite the slewing housing 2 adjustable in an angle, in order to assure grinding of the rail head 7 with several grinding groups as true to shape as possible. The FIG. 3 shows that the plate 12 is provided with a guiding length "F" at the rail head 7 which is sufficient to bridge over even grooves with long waves. The guide at the rail head 7 is performed in a large distance "R" from the center turning point, so that the plate 12 is turned at the same time by the touch of the rail with only little slipping movement, thus reducing the wear of the plate 12 considerably and facilitating the advance movement of the machine.

I claim:

1. Rail Head Re-Form Grinding Machine with rotating grinding wheel operating at the front end, through the center of which a feeler device is provided immediately within the grinding border of the grinding wheel and connected to an indicating device, marked by the feeler device being an even plate (12) filling out almost the clear width of the grinding wheel (6) and being affixed pivoting at an axially adjustable axle (13), furthermore by the feeler device being adjustable by means of pressure (18) and the adjusting distance which can be registrated via an indication device (22, 23).

2. A machine as per claim 1 characterized by pressure means for increasing or reducing the weight on the feeler device.

3. Machine as per claim 1, characterized by the grinding pressure being controlled by hand or automatically, shown via an indicating instrument for the current pick-up of the grinding motor.

4. Machine as per claim 1, characterized by the feeler device and the grinding wheel (6) being adjustable in a semi-cercle around the rail head (7) by means of a guiding housing (25) slewable in an angle.

5. Machine as per claim 1, characterized by the feeler device and the grinding wheel (6) being removed from and put on to the rail in a semi-cercle by means of cylinder piston group (4), in order to achieve thereby a free access for easy exchange of wearing parts.

6. A rail head re-form grinding machine adapted for grinding the rail head to the prescribed contour, comprising a housing, an annular grinding wheel rotatably carried by said housing, the grinding wheel having upper and lower flat faces with the lower face adapted to engage the rail head, power means to rotate said grinding wheel, a feeler disc rotatably carried within the annular grinding wheel and adapted to contact the rail head, means for supporting the feeler disc in an adjustable vertical manner, power and control means for vertically displacing the feeler disc, and sensing and indicating means for determining and showing the vertical movement of the feeler disc.

7. The invention as set forth in claim 6 and wherein mounting means are provided for the housing whereby the housing and grinding wheel carried thereby may be arcuately moved to grind the rail head in the prescribed contour.

8. The invention as set forth in claim 7 and wherein hydraulic power means are provided for the housing which carries the grinding wheel and feeler disc and sensing means connected to the power means which rotate the grinding wheel to indicate the power being consumed to rotate the grinding wheel.

* * * * *